US011142289B1

(12) United States Patent
Anderson

(10) Patent No.: US 11,142,289 B1
(45) Date of Patent: Oct. 12, 2021

(54) ACCESSORY SUPPORT DEVICE FOR BOAT SEAT

(71) Applicant: C. Scott Anderson, Bennettsville, SC (US)

(72) Inventor: C. Scott Anderson, Bennettsville, SC (US)

( * ) Notice: Subject to any disclaimer, the term of this patent is extended or adjusted under 35 U.S.C. 154(b) by 9 days.

(21) Appl. No.: 16/781,122

(22) Filed: Feb. 4, 2020

Related U.S. Application Data

(60) Provisional application No. 62/800,721, filed on Feb. 4, 2019.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS

| | | | | |
|---|---|---|---|---|
| 4,318,567 | A | 3/1982 | Guthier | |
| 4,428,617 | A | 1/1984 | Lawson | |
| 4,645,167 | A * | 2/1987 | Hardwick | B63B 29/04 248/283.1 |
| 5,240,020 | A * | 8/1993 | Byers | A47C 7/66 135/96 |
| 5,577,458 | A | 11/1996 | Kohl | |
| 6,681,517 | B1 * | 1/2004 | Solomon | A01K 97/10 43/21.2 |
| 7,540,561 | B2 * | 6/2009 | McWhorter | A47C 7/66 297/184.16 |
| 7,882,795 | B1 | 2/2011 | Snyder | |
| 8,726,921 | B2 * | 5/2014 | Wilkins | A45B 3/02 135/25.4 |
| 9,194,152 | B1 * | 11/2015 | Plasencia | E04H 15/48 |
| 9,555,862 | B1 * | 1/2017 | Sutherland | B63B 29/04 |
| 10,059,407 | B1 * | 8/2018 | Ingalls | B63B 17/02 |
| 10,791,725 | B2 * | 10/2020 | Castillo | A01K 97/10 |
| 2006/0272688 | A1 * | 12/2006 | McWhorter | A45B 11/00 135/16 |
| 2008/0029137 | A1 * | 2/2008 | McInville | E04H 12/2269 135/16 |
| 2014/0203600 | A1 | 7/2014 | Rushing | |
| 2017/0225752 | A1 * | 8/2017 | O'Neal | B63B 29/06 |

* cited by examiner

*Primary Examiner* — Lars A Olson
*Assistant Examiner* — Jovon E Hayes
(74) *Attorney, Agent, or Firm* — P. Jeff Martin; The Law Firm P. Jeffrey Martin, LLC

(57) ABSTRACT

An accessories mounting arrangement for a recreational seat includes a planar mounting plate adapted and configured to be mounted superjacent to a pedestal seat plate or pedestal, or otherwise a pedestal assembly, with the plate supporting the attachment and positioning of a seat. The mounting plate is disposed between the pedestal assembly and the underside surface of the seat that is generally attached to the pedestal assembly. The mounting plate has a tubular member upwardly depending and extending the top surface of the plate and adapted to slidably receive an umbrella support post/shaft in a snug-fit manner.

15 Claims, 3 Drawing Sheets

ACCESSORY SUPPORT DEVICE FOR BOAT SEAT

I. RELATED APPLICATIONS

This application claims priority to U.S. Provisional Patent Application No. 62/800,721 filed on Feb. 4, 2019, the disclosure of which is hereby incorporated by reference in its entirety.

II. FIELD OF THE INVENTION

The present application discloses and describes a device mounted to a seat pedestal that supports recreational accessories, such as a shading umbrella and/or a fishing rod.

III. BACKGROUND OF THE INVENTION

Physical support of recreational accessories has posed significant challenges. The lack of dedicated, physical structure(s) to support such accessories usually results in individuals improvising and/or repurposing items on-hand to secure articles such as umbrellas, tools, and/or other implements in place. Such support has proven to be even more challenging when a mobile vehicle, such as a boat or ship, is utilized or part of the environmental situation.

One attempt includes U.S. Patent Application No. 2014/0203600 (filed by Rushing) discloses an accessory support device for a pedestal boat seat that recites a sleeve with bore that is placed on the pedestal post, the sleeve having an angled arm supporting a carrier that articles or accessories may be placed and temporarily secured.

Similarly, another attempt disclosed in U.S. Patent Application No. 2017/0225752 (filed by O'Neal) discloses a boat seat accessory stand that recites a sleeve member having upper and lower braces and an upright support depending therefrom that receives and supports a shafted article, such as an umbrella.

However, at least one drawback to the proposed solutions includes the obtrusive size and interference that the solutions introduce to someone using the seat.

Other Attempts Include the Following:

U.S. Pat. No. 4,318,567 issued to Guthier and disclosing an observation device that includes a ground post, a seat at an upper end of the ground post and a support at the lower end of the ground post, and includes the ability to mount an umbrella in a pivotal orientation;

U.S. Pat. No. 4,428,617 issued to Lawson and disclosing a boat seat fishing accessory-arm rest support assembly for use in combination with a fishing boat pedestal mounted swivel seat to provide convenient receipt in detachable connection fishing tackle and equipment holding containers;

U.S. Pat. No. 4,645,167 issued to Hardwick disclosing an accessory mounting arrangement for boat seats that mounts a rotatable boat chair and a plurality of support arms for holding fishing gear and accessories;

U.S. Pat. No. 5,577,458 issued to Kohl disclosing a pedestal mounted seat tackle box assembly having a seat with a storage base;

U.S. Pat. No. 6,681,517 issued to Solomon disclosing a fishing rod holder for mounting on a pedestal of and under a seat of a fishing chair for retaining one or more fishing rods in a variety of angularly oriented positions;

U.S. Pat. No. 7,882,795 issued to Snyder disclosing an adjustable fisherman seat assembly that includes an elongated base member and a seat section, a mechanism for adjusting the seat, a fishing rod holder, and a mechanism for supporting the fisher's feet;

U.S. Pat. No. 9,555,862 issued to Sutherland disclosing a rotatable boat rail having a cylinder defining a passageway and a L-shaped member having a horizontal section and a vertical section coupled to the cylinder, the rail providing assistance for users entering or exiting the boat or vessel; and U.S. Patent Application No. 2006/0272688 (filed by McWhorter et al.) disclosing a boat seat umbrella assembly for providing shade to an individual.

Accordingly, there is a need for an improved support for such recreational articles and/or tools.

IV. SUMMARY OF THE INVENTION

In one embodiment, an accessories mounting arrangement for boat seats, the mounting arrangement comprises a planar mounting plate adapted and configured to mount a pedestal assembly, a plurality of apertures formed through the width of the plate for alignment to and accommodating the positioning and placement of the plate between the pedestal assembly and the seat, and a tubular member extending vertically from the mounting plate, the tubular member slidably receiving an umbrella support post/shaft in a snug-fit manner.

The mounting arrangement may further comprise an armrest apparatus extending upwardly from the mounting plate, the armrest apparatus telescopically adjustable. The mounting arrangement may also further comprise a beverage holder.

The mounting arrangement may also further comprise a fishing accessories support having at least one tubular sleeve slidably receiving at least one fishing rod. In such an embodiment, each one of the tubular sleeves comprise a securing mechanism for detachably securing each of the plurality of fishing rods within respective tubular sleeves.

An accessories mounting arrangement for boat seats, the mounting arrangement comprises a planar mounting plate adapted and configured to mount a pedestal assembly, the mounting plate having a plurality of apertures formed through the width of the plate for alignment to and accommodating the positioning and placement of the plate between the pedestal assembly and the seat, a tubular member upwardly depending and extending vertically from the mounting plate, the tubular member disposed at the rear of the plate and slidably receiving an umbrella support shaft in a secure manner, the tubular member supporting and disposing the umbrella at the rear of the seat;

and a first armrest apparatus articulating between a raised and lowered position The first armrest apparatus may further comprise one or more beverage holders. The first armrest apparatus is disposed along one lateral side of the seat.

The mounting arrangement may also further comprise a second armrest apparatus, the first armrest apparatus and the second armrest apparatus mutually opposed and disposed in parallel along opposing lateral sides of the seat.

The mounting arrangement may also further comprise a fishing accessories support having at least one tubular sleeve adapted to slidably receive at least one or a plurality of fishing rods. The at least one tubular sleeve comprises a securing mechanism for detachably securing each of the plurality of fishing rods within each one of the respective tubular sleeves.

An accessories mounting arrangement for boat seats, the mounting arrangement comprises a planar mounting plate adapted and configured to mount a pedestal assembly, the mounting plate having a plurality of apertures formed through the width of the plate for alignment to and accommodating the positioning and placement of the plate between the pedestal assembly and the seat, a tubular member upwardly depending and extending vertically from the mounting plate, the tubular member disposed at the rear of the plate and slidably receiving an umbrella support shaft in a secure manner, the tubular member supporting and disposing the umbrella at the rear of the seat, and, a unitary armrest attachment comprising a C-shaped member extending integrally into a pair of armrests.

The unitary armrest attachment further comprises a cylindrical receiver extending downward integrally approximately intermediate the C-shaped member for slidably engaging the tubular member of mounting plate. In one embodiment, the unitary armrest attachment is securably mounted superjacent to the mounting plate. In another embodiment, the unitary armrest attachment is securably mounted superjacent to the pedestal assembly.

The mounting arrangement may also further comprise a fishing accessories support having at least one tubular sleeve adapted to slidably receive at least one or a plurality of fishing rods. The at least one tubular sleeve comprises a securing mechanism for detachably securing each of the plurality of fishing rods within each one of the respective tubular sleeves.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
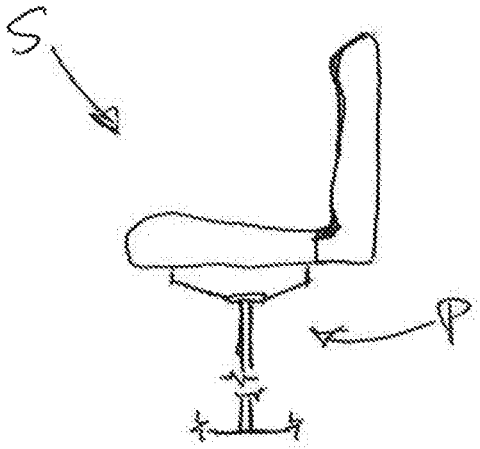
FIG. 1 is a side view of a seat and pedestal assembly typically found on a recreational platform or vehicle.

Consistent with the illustrations appended hereto, as embodied in FIGS. 2-10, an accessories mounting arrangement 10 for a recreational seat is depicted and described. As one example, and consistent with that depicted in FIG. 1, a recreational seat may include but is not limited to various embodiments such as a fixed, stationary seat found on a recreational vehicle (e.g., nautical vessel, including pontoons, boats, ships, and the like) or a fixed, stationary seat found on a fixed, stationary platform (e.g., a pier), or a non-fixed, mobile seat found on vessels or fixed platforms. It is envisioned that the arrangement 10 may comprise several embodiments incorporated into the various environments described above.

Figure 2:
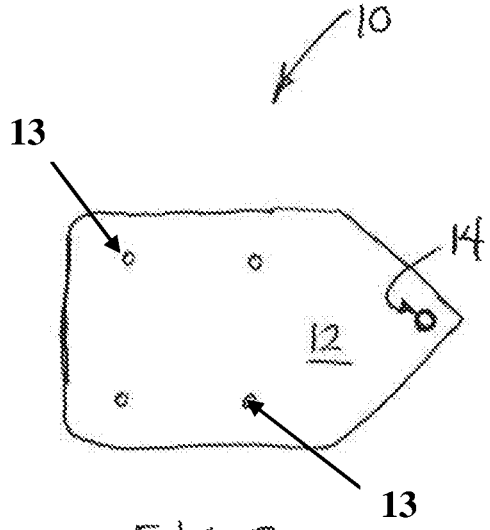
FIG. 2 is a plan view of the accessories mounting arrangement as described herein.
Figure 3:
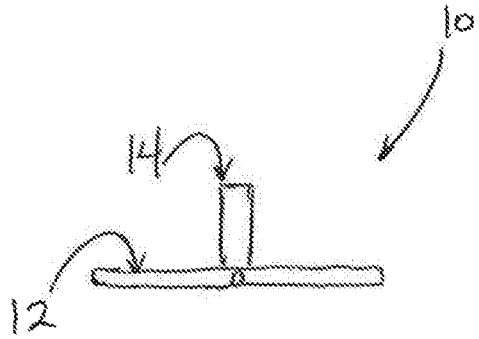
FIG. 3 is an end-view of FIG. 2.
Figure 4:
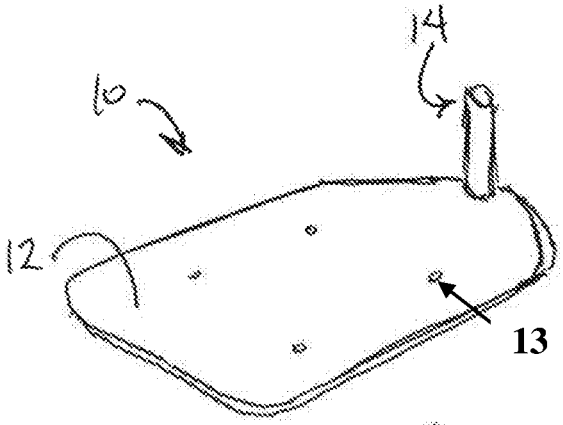
FIG. 4 is a perspective view of FIGS. 2 and 3.

For example, consistent with FIG. 2, the arrangement 10 may comprise a planar mounting plate 12 adapted and configured to be mounted superjacent a pedestal seat plate or pedestal, or otherwise a pedestal assembly (P), that supports the attachment and positioning of a seat (S). Therefore, consistent with FIG. 9, the mounting plate 12 is disposed between the pedestal assembly and the underside surface of the seat that is generally attached to the pedestal assembly. The mounting plate 12 comprises a top surface and a bottom surface, the surfaces opposing one another and separated by the width of the plate 12, wherein the top surface of the plate 12 supports the underside surface of the seat and the bottom surface engages the pedestal assembly (P). The mounting plate 12 may comprise a tubular member 14 upwardly depending and extending the top surface of the plate 12 and adapted to slidably receive an umbrella support post/shaft in a snug-fit manner.

The mounting plate 12 may have a variety of configurations, including an orthogonal form (e.g., square or rectangle), an irregular pentagonal form, or other such polygonal variations. The mounting plate 12 may also include a plurality of apertures 13 formed through the width of the plate 12 for alignment to and accommodating the positioning and placement of the plate 12 between the pedestal assembly and the seat. The mounting plate 12 may be formed from a variety of materials, including metal, alloys, composites, plastics, ceramics, woods, and/or combinations thereof where appropriate. In most instances, metal and/or a metal alloy, and in particular, aluminum and/or an aluminum alloy is envisioned as the most suitable, possessing the optimal combination of strength, durability, and aesthetic appropriate for exterior use with exposure to environmental elements such as water, wind, and extreme heat and/or cold.

Figure 5:
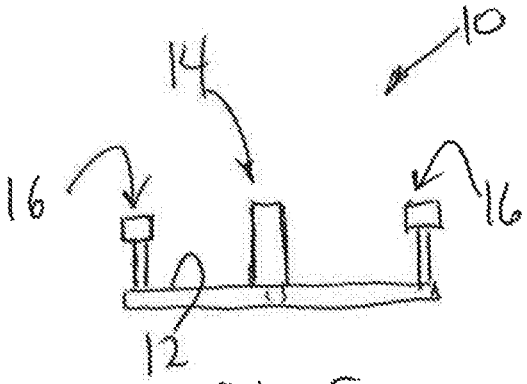
FIG. 5 is an alternative end-view of FIG. 2 depicting one or more armrest apparatuses.

Consistent with FIG. 5, the mounting plate 12 may also include an armrest apparatus 16 that is upwardly extending. The armrest apparatus 16 may be telescopically adjustable or otherwise articulating between a raised and lowered position and comprise one or more beverage holders 17 (see FIG. 8). In one embodiment, the plate 12 comprises a single armrest apparatus 16 disposed in a manner allowing alignment of the armrest apparatus 16 along one lateral side of the seat. In another embodiment, consistent with FIG. 5, the plate 12 comprises two armrest apparatuses 16 disposed in a manner allowing alignment of the two armrest apparatuses 16 along opposing, parallel lateral sides of the seat.

Figure 6:
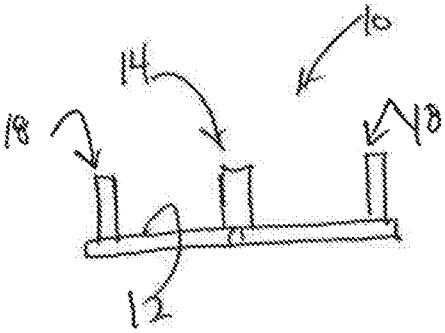
FIG. 6 is an alternative end-view of FIG. 2 depicting one or more tubular sleeves.
Figure 7:
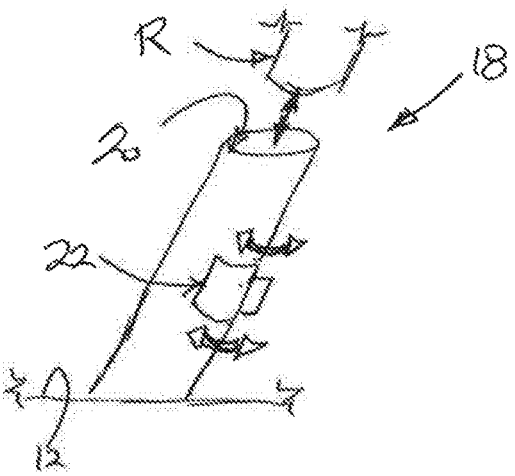
FIG. 7 is a perspective view of one of the tubular sleeves of FIG. 6.
Figure 8:
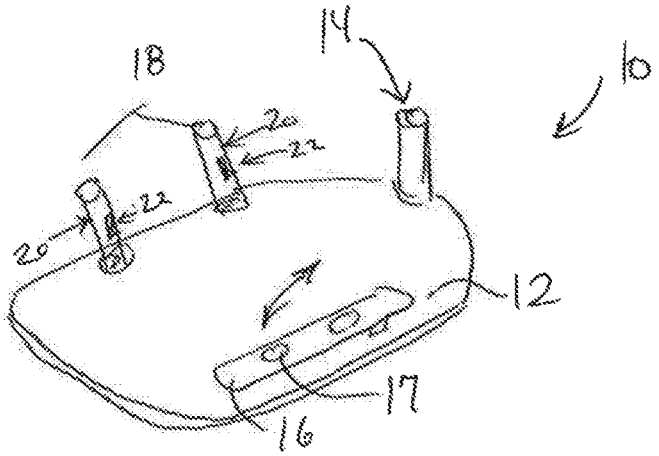
FIG. 8 is a perspective view of FIG. 6.
Figure 9:
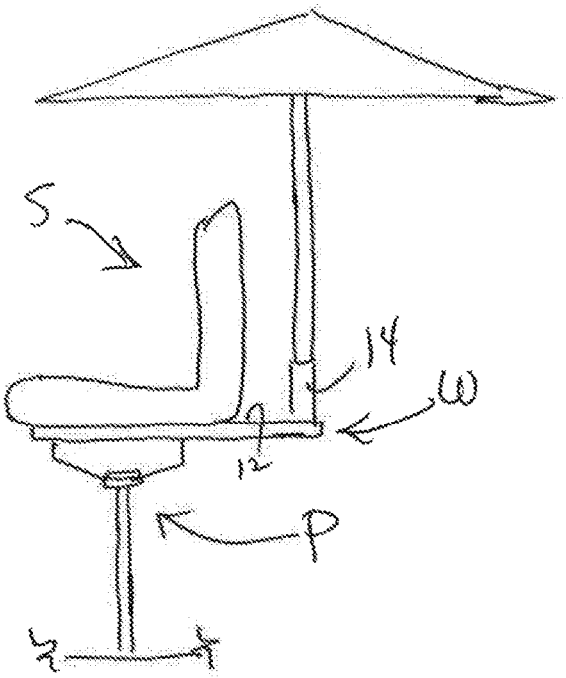
FIG. 9 is a side-view of the accessories mounting arrangement as installed on a recreational seat and supporting a shading umbrella.

Consistent with FIG. 6, and more particularly illustrated in FIG. 7, the mounting plate 12 may also include a fishing accessories support 18 having at least one tubular sleeve 20 or a series of tubular sleeves 20 for slidably receiving at least one or a plurality of fishing rods (R), respectively, wherein the tubular sleeves 20 may each comprise a securing mechanism 22, such as a compression clamp, for detachably securing each of the plurality of fishing rods (R) within respective tubular sleeves 20.

Figure 10:
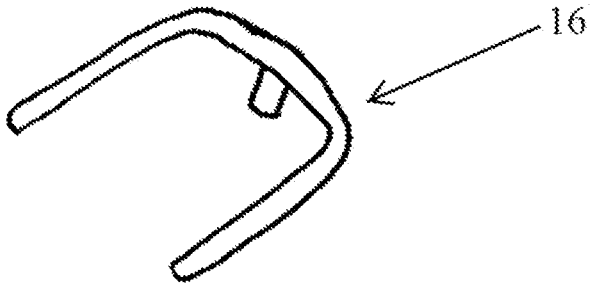
FIG. 10 is a perspective view illustrating an accessories mounting arrangement in accordance to another embodiment of the present invention.
Figure 10A:
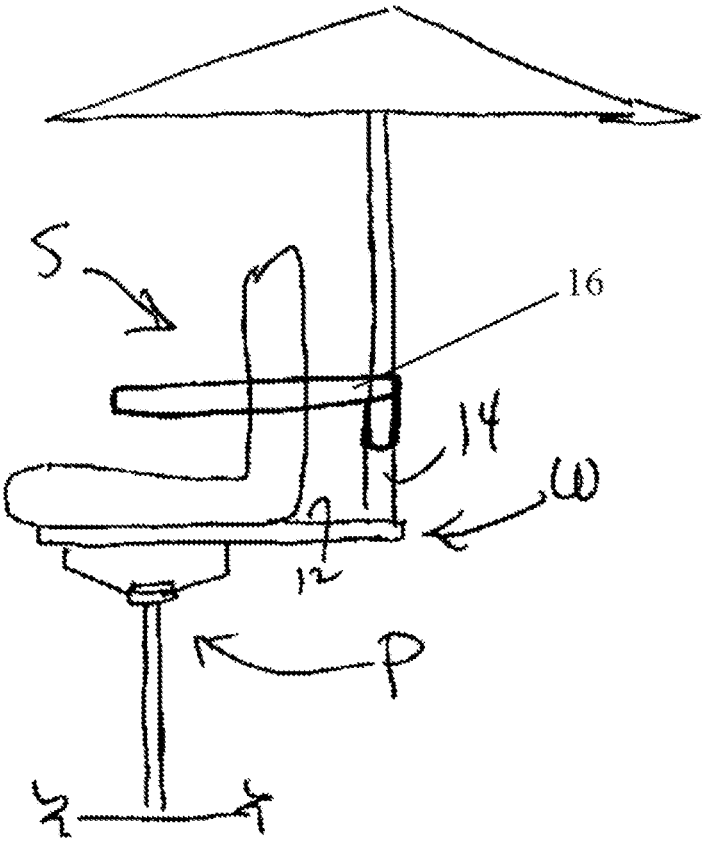
FIG. 10A is a side-view of the accessories mounting arrangement of FIG. 10 shown installed on a recreational seat and also supporting a shading umbrella, in accordance to one embodiment of the present invention.

Finally, in reference to FIGS. 10-10A, and in accordance to another embodiment, an accessories mounting arrangement in the form of a unitary armrest attachment 16 is depicted. The unitary armrest attachment 16 comprises a generally C-shaped member extending integrally into a pair of armrests. The unitary armrest attachment 16 further comprises a cylindrical receiver extending downward integrally approximately intermediate the C-shaped member for slidably engaging the tubular member 14 of mounting plate 12. Alternatively, it is envisioned the unitary armrest attachment 16 may be securably mounted, such as via arc welding, superjacent the mounting plate 12, the pedestal seat plate or pedestal, or otherwise a pedestal assembly (P).

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. An accessories mounting arrangement for boat seats, the mounting arrangement comprising:

a planar mounting plate adapted and configured to mount a pedestal assembly;

a plurality of apertures formed through the width of the plate for alignment to and accommodating the positioning and placement of the plate between the pedestal assembly and the seat;

a tubular member extending vertically from the mounting plate, the tubular member slidably receiving an umbrella support post/shaft; and an armrest apparatus extending upwardly from the mounting plate, the armrest apparatus telescopically adjustable.

2. The mounting arrangement of claim 1 further comprising a beverage holder.

3. The mounting arrangement of claim 1, further comprising a fishing accessories support having at least one tubular sleeve slidably receiving at least one fishing rod, respectively, wherein each one of the tubular sleeves comprises a securing mechanism for detachably securing each one of the fishing rods within respective tubular sleeves.

4. An accessories mounting arrangement for boat seats, the mounting arrangement comprising:

a planar mounting plate adapted and configured to mount a pedestal assembly, the mounting plate having a plurality of apertures formed through a width of the plate for alignment to and accommodating a positioning and placement of the plate between the pedestal assembly and a boat seat;

a tubular member upwardly depending and extending vertically from the mounting plate, the tubular member disposed at a rear of the plate and slidably receiving an umbrella support shaft in a secure manner, the tubular member supporting and disposing an umbrella at a rear of the boat seat; and a first armrest apparatus articulating between a raised and lowered position.

5. The mounting arrangement of claim 4 wherein the first armrest apparatus further comprises one or more beverage holders.

6. The mounting arrangement of claim 4 wherein the first armrest apparatus is disposed along one lateral side of the boat seat.

7. The mounting arrangement of claim 4 further comprising a second armrest apparatus, the first armrest apparatus and the second armrest apparatus mutually opposed and disposed in parallel along opposing lateral sides of the boat seat.

8. The mounting arrangement of claim 4 further comprising a fishing accessories support having at least one tubular sleeve adapted to slidably receive at least one or a plurality of fishing rods.

9. The mounting arrangement of claim 8, wherein the at least one tubular sleeve comprises a securing mechanism for detachably securing each of the plurality of fishing rods within each one of the respective tubular sleeves.

10. An accessories mounting arrangement for boat seats, the mounting arrangement comprising:

a planar mounting plate adapted and configured to mount a pedestal assembly, the mounting plate having a plurality of apertures formed through a width of the plate for alignment to and accommodating a positioning and placement of the plate between the pedestal assembly and a boat seat;

a tubular member upwardly depending and extending vertically from the mounting plate, the tubular member disposed at a rear of the plate and slidably receiving an umbrella support shaft in a secure manner, the tubular member supporting and disposing an umbrella at a rear of the boat seat; and a unitary armrest attachment comprising a C-shaped member extending integrally into a pair of armrests.

11. The mounting arrangement of claim 10, wherein the unitary armrest attachment further comprises a cylindrical receiver extending downward integrally approximately intermediate the C-shaped member for slidably engaging the tubular member of the mounting plate.

12. The mounting arrangement of claim 11, wherein the unitary armrest attachment is securably mounted superjacent to the mounting plate.

13. The mounting arrangement of claim 11, wherein the unitary armrest attachment is securably mounted superjacent to the pedestal assembly.

14. The mounting arrangement of claim 10 further comprising a fishing accessories support having at least one tubular sleeve adapted to slidably receive at least one or a plurality of fishing rods.

15. The mounting arrangement of claim 14, wherein the at least one tubular sleeve comprises a securing mechanism for detachably securing each of the plurality of fishing rods within each one of the respective tubular sleeves.

* * * * *